US009151027B2

(12) United States Patent
Lucas

(10) Patent No.: US 9,151,027 B2
(45) Date of Patent: Oct. 6, 2015

(54) BATHROOM FITTINGS

(75) Inventor: Timothy George Lucas, Rochedale (AU)

(73) Assignee: ART PLASTICS PTY LTD, Western Australia (AU)

( * ) Notice: Subject to any disclaimer, the term of this patent is extended or adjusted under 35 U.S.C. 154(b) by 880 days.

(21) Appl. No.: 13/283,837

(22) Filed: Oct. 28, 2011

(65) Prior Publication Data

US 2012/0102640 A1 May 3, 2012

(30) Foreign Application Priority Data

Nov. 3, 2010 (AU) ..... 201014726
Jun. 7, 2011 (AU) ..... 2011202706

(51) Int. Cl.
*E03C 1/23* (2006.01)

(52) U.S. Cl.
CPC ..... *E03C 1/2302* (2013.01); *E03C 1/2306* (2013.01)

(58) Field of Classification Search
CPC ..... E03C 1/23
USPC ..... 4/679–694
See application file for complete search history.

(56) References Cited

U.S. PATENT DOCUMENTS

| | | | | |
|---|---|---|---|---|
| 4,276,662 | A * | 7/1981 | Young | 4/295 |
| 5,787,521 | A * | 8/1998 | O'Connell et al. | 4/689 |
| 5,819,328 | A * | 10/1998 | Lewis | 4/295 |
| 5,822,812 | A * | 10/1998 | Worthington et al. | 4/689 |
| 6,023,795 | A * | 2/2000 | Potter et al. | 4/652 |
| 6,347,417 | B1 * | 2/2002 | Ohta | 4/689 |
| 7,886,372 | B2 * | 2/2011 | Jacobs | 4/295 |
| 7,971,288 | B2 * | 7/2011 | Hackett | 4/679 |
| 8,201,581 | B2 * | 6/2012 | George | 137/876 |
| 8,214,942 | B2 * | 7/2012 | Yang et al. | 4/685 |
| 8,590,065 | B2 * | 11/2013 | Ali et al. | 4/287 |
| 2006/0179564 | A1 * | 8/2006 | Jacobs | 4/689 |
| 2006/0195976 | A1 | 9/2006 | McAlpine | |
| 2009/0007329 | A1 * | 1/2009 | Hackett | 4/679 |

FOREIGN PATENT DOCUMENTS

GB 2373182 9/2002

OTHER PUBLICATIONS

Examination Report dated Oct. 14, 2014 for corresponding Australian patent application No. 2014100936.

* cited by examiner

*Primary Examiner* — Lori Baker
(74) *Attorney, Agent, or Firm* — Abelman, Frayne & Schwab

(57) ABSTRACT

A bath or basin waste having a plug in which the upper face of the cap is substantially below the upper face of the bottom of the bath or basin to which it is fitted when in the closed position and substantially flush with the upper face of the bottom of the bath or basin when in the open position.

15 Claims, 4 Drawing Sheets

BATHROOM FITTINGS

CROSS-REFERENCE TO RELATED APPLICATIONS

This application is based on and claims priority from Australian Patent Application No. 2011202706, filed on Jun. 7, 2011, and Australian Design Application No. 201014726, filed Nov. 3, 2010, now Australian Registered Design No. 334709, with the Australian Patent Office, the disclosures of which are incorporated herein in their entirety by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION (1) Field of the Invention

This invention relates to fittings for bathroom facilities and in particular fittings commonly known as bath or basin outlets or wastes.

(2) Description of Related Art Including Information Disclosed Under 37 CFR 1.97 and 1.98

One well known basic type of bath and basin waste has an externally threaded tube defining a flow passage therethrough from its upper end to its lower end and which is adapted to fit into the drain opening provided in a bathtub or basin. A flange extends outwardly from the tube at its upper end and is arranged to engage the upper face of the bath or basin bottom about the drain opening. Typically, a flat rubber washer is fitted about the tube between the flange and the basin and a nut is screwed onto the tube so as to engage the lower face of the basin bottom and tighten the flange against the washer so that it forms a watertight seal therebetween. A trap or pipe is then connected to the lower end of the tube and in turn connected to a waste water drainage pipe which eventually is connected to the sewerage system. A grate is usually fitted in the tube adjacent the flange and is often cast therewith to prevent passage of cakes of soap, cloth and the like. Sometimes the grate is formed separately and is secured in the tube by a screw which is screwed into the centre of intersecting a diametral cross bars which are cast in the tube (commonly known as a "spider"). The upper end portion adjacent the flange is usually tapered inwards away from the upper end to accommodate a removable tapered plug therein for closing the flow passage.

A more recent type of basin outlet commonly referred to as a "pop-up" waste or outlet has become popular because it does not require a separate plug. Such basin outlets typically have a tube and flange similar to the basic bath and basin outlet described above but instead of a removable plug being used to close the flow passage, a cap is mounted in the flow passage adjacent the flange for up and down movement between an open position and a closed position so as to close the passage when it is down and open the passage when it is up.

In such known pop-up type outlets the cap seals against the flange or the inner face of the tubular portion immediately adjacent the upper end when down to close the passage and is spaced above the flange when up thereby opening the passage at its upper end. Movement of the cap is controlled by an actuation device to which the cap is connected such that closing of the passage is achieved by pushing the cap down against a spring loaded catch and released by pushing the cap further down to release the catch so that it rises to the open position under the force of a spring. In such pop-up type basin wastes, the upper face of the cap is normally flush with the flange (and the upper face of the basin bottom) when the cap is down in the closed position but protrudes significantly above the flange (and the basin bottom) when in the open position.

It will be appreciated that a large number of persons who use a wash basin to quickly wash their faces and hands or clean their teeth prefer to do so with running water direct from the basin faucet while the basin outlet is open and water can flow directly out of the basin. Unfortunately, the protruding cap of the presently available basin wastes can be a nuisance in such cases. Furthermore, the basin waste is typically more aesthetically pleasing when in the closed position than the open position but is rarely in the closed position and many people prefer to leave the basin waste open when not in use so that any drips drain away rather than overflow the basin.

BRIEF SUMMARY OF THE INVENTION

The present invention is aimed at providing an alternative basin outlet which has some of the advantages of the pop-up type waste but which does not significantly protrude into the basin when in the open position. The invention is also aimed at providing a basin outlet which is more aesthetically pleasing when in the open position.

The aim of the invention is achieved by providing a bath or basin waste in which the cap is below the upper face of the flange when in the closed position and substantially flush with the upper face of the flange when in the open position.

The invention resides broadly in a bath or basin waste, including:

a tube defining a flow passage with an inlet at its upper end, an outlet at its lower end, and an outwardly extending flange at or adjacent its upper end;

a plug mounted in the flow passage for up and down movement between an open position in which the plug is up and a closed position when it is down, the plug having an upper face which is substantially flush with the upper face of the flange when in the open position and below the upper face of the flange when in the closed position; and actuation means mounted in the flow passage and connected to the plug for actuating movement of the plug relative to the tube between the closed position and the open position.

In another aspect, the invention resides broadly in a bath or basin waste, including:

a tube defining a flow passage with an inlet at its upper end, an outlet at its lower end, and an outwardly extending flange at or adjacent one end;

a plug mounted in the flow passage for up and down movement between an open position in which water can flow between the plug and the tube and a closed position in which flow between the plug and the tube is prevented, the plug having an upper face which is substantially flush with the upper face of the flange when in the open position but below the upper face of the flange when in the closed position; and actuation means mounted in the flow passage and connected to the plug for actuating movement of the plug relative to the tube between the closed position and the open position.

Preferably, the plug is adapted to sealably engage with the inner face of the tube to close the flow passage when in the closed position and to disengage from the inner face when in the open position so as to allow water to flow through the flow passage. In one preferred form, the plug includes an outwardly extending circumferential flange which engages with a circumferential flange extending inwardly from the inner face of the tube when in the closed position thereby closing the flow passage. In such case, it will be appreciated that an annular passage is formed between the two flanges when the plug is in the open position but the annular passage is closed by engagement of the two flanges. However, other suitable arrangements are possible, for example, the plug may include a flange adapted to engage the inner face of the tube when in the closed position and a circumferential recess may be formed in the tube so that the flange is disengaged when aligned with the recess.

Preferably, the plug has a top cap which together with the tube defines a space therebetween through which water can flow. In such form, it is preferred that the space be an annular space so that water can flow all around the cap when in the open position. It is also preferred that the cap have and a skirt depending therefrom with the cap being connected to the actuation means via the skirt. In such form it is preferred that the cap be screwed onto the plug so that it can easily be removed to facilitate replacement of the actuation means.

Preferably, the actuation means includes a spindle which is screw threadedly mounted to the tube and the plug is slidably mounted on the spindle. In such form, it is preferred that the plug be opened and closed by pushing down on the plug against a spring in the actuation means. However, in other forms of the invention, the plug could be opened and closed by a push rod linked to a lever pivoted in the tube below the basin in which the waste is mounted.

In this specification the bath or basin waste has been described in its normal in use position when fitted to a bath or basin drain and terms such as "vertical", "upper", "lower" and the like relative terms have been used to reference parts from that perspective. However, it is to be understood that such terms are not intended to limit use of the bath or basin waste to any particular orientation.

BRIEF DESCRIPTION OF THE SEVERAL VIEW OF THE DRAWINGS

In order that the invention may be more readily understood and put into practice, reference will now be made to the accompanying drawings wherein.

DETAILED DESCRIPTION OF THE INVENTION

Figure 1:
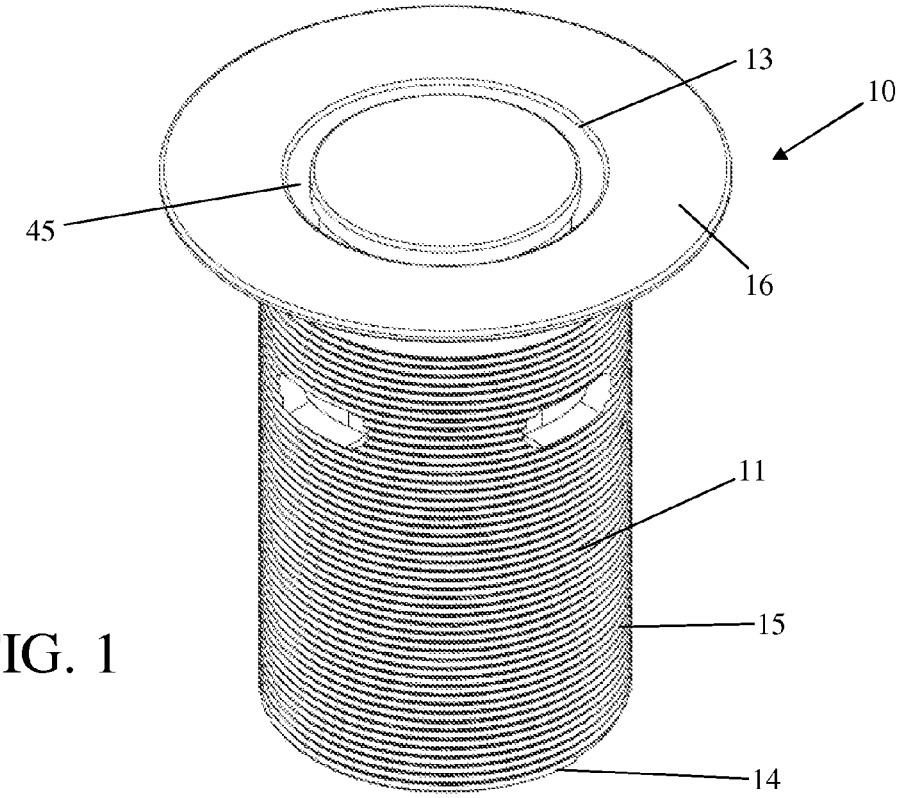
FIG. 1 is an isometric view of a basin waste according to the invention with the plug in the open position.

The basin waste 10 illustrated in FIG. 1 includes a tube 11 defining a passage 12 therethrough with an inlet opening 13 at its upper end, an outlet opening 14 at its lower end, and a flange 16 extending outwardly from the tube adjacent its upper end. The outer face of the tube is threaded as shown at 15 for screw threadedly receiving a nut thereon for securing the waste in the drain outlet of a wash basin with a flat rubber washer fitted about the tube between the flange and the basin to form a watertight seal therebetween.

Interconnecting diametral cross member 17 bridges the passage towards its lower end to provide a mount for a plug assembly 21 which is mounted thereto as will be described in more detail later.

Figure 2:
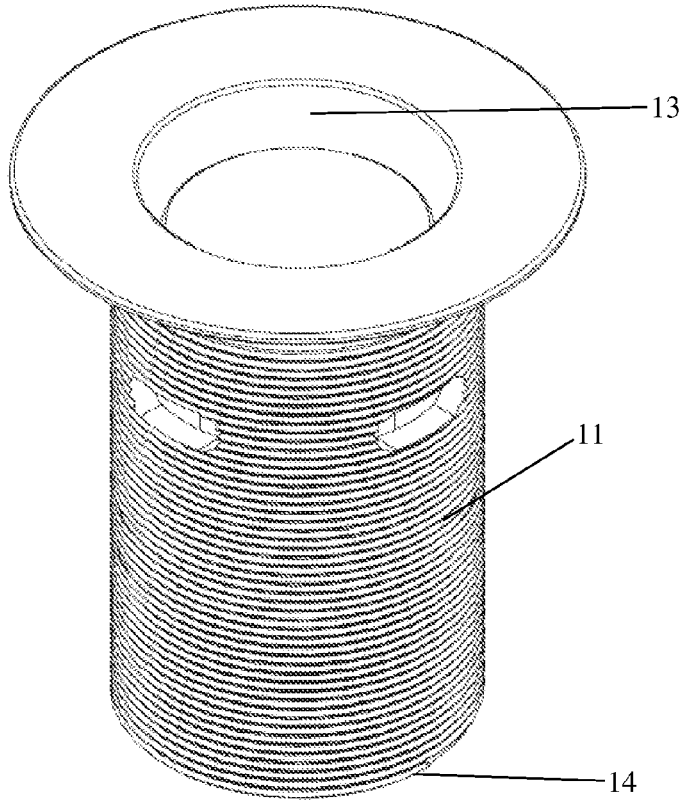
FIG. 2 is an isometric view of the basin waste of FIG. 1 with the plug in the closed position.
Figure 3:
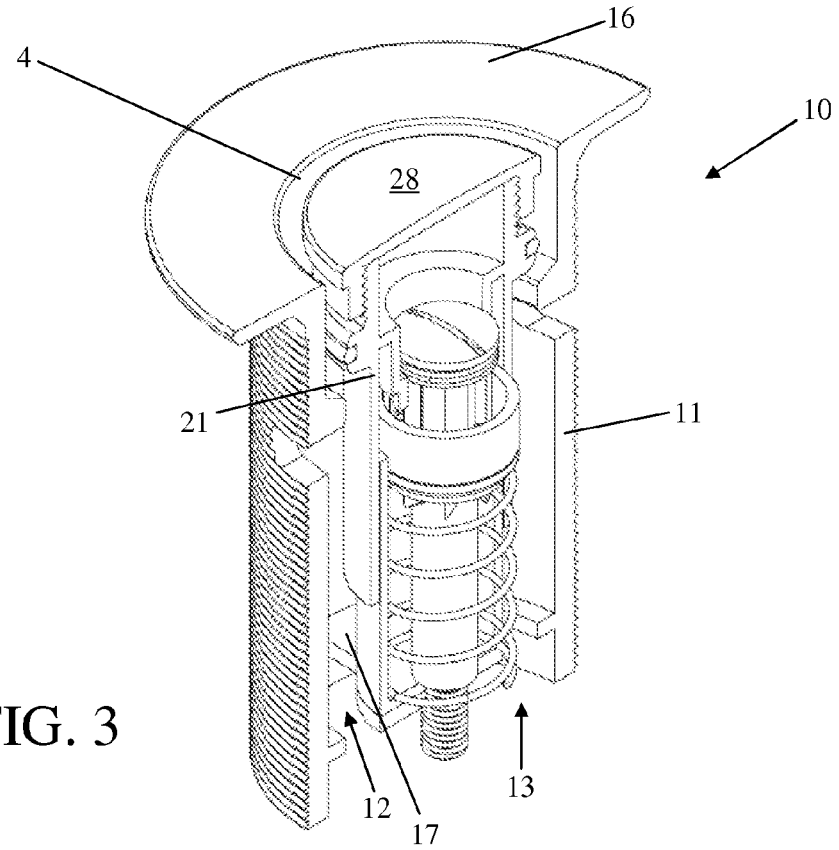
FIG. 3 is a sectional isometric view of the basin waste of FIG. 1 along a diametral vertical plane with the plug in the open position.
Figure 4:
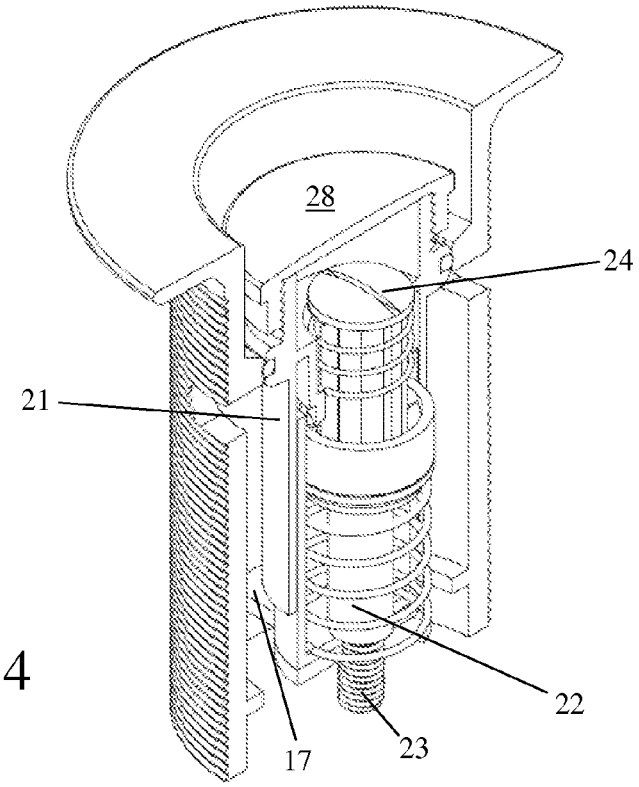
FIG. 4 is a sectional isometric view of the basin waste of FIG. 1 along the same diametral vertical plane as FIG. 3 with the plug in the closed position.
Figure 5:
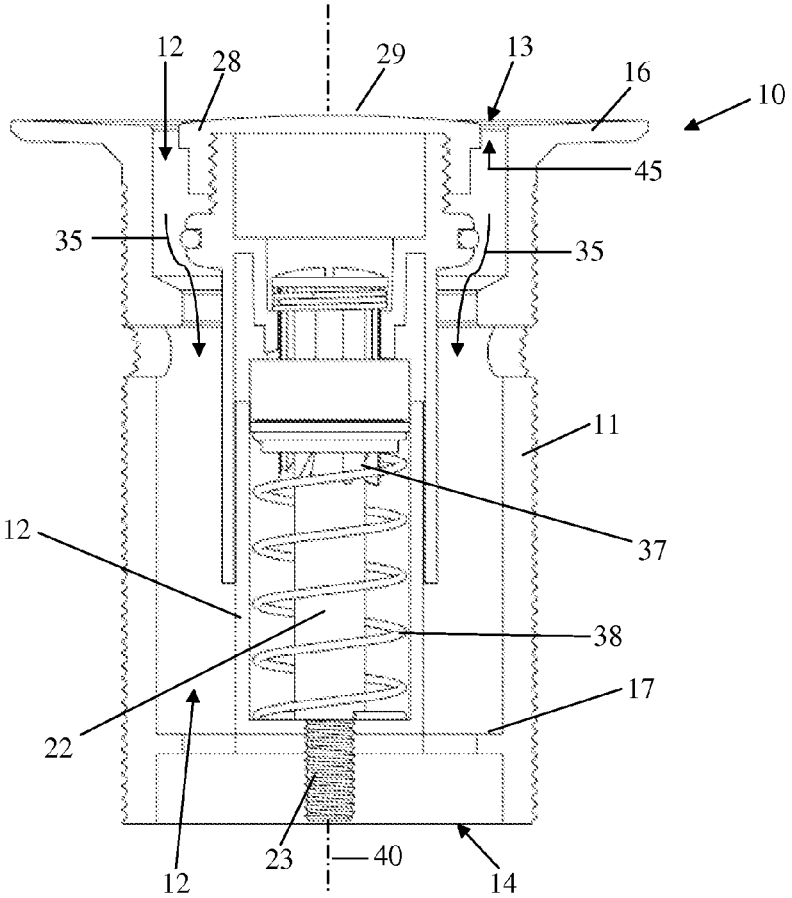
FIG. 5 is a sectional elevation of the plug of FIG. 1 along a diametral plane with the plug in the open position.
Figure 6:
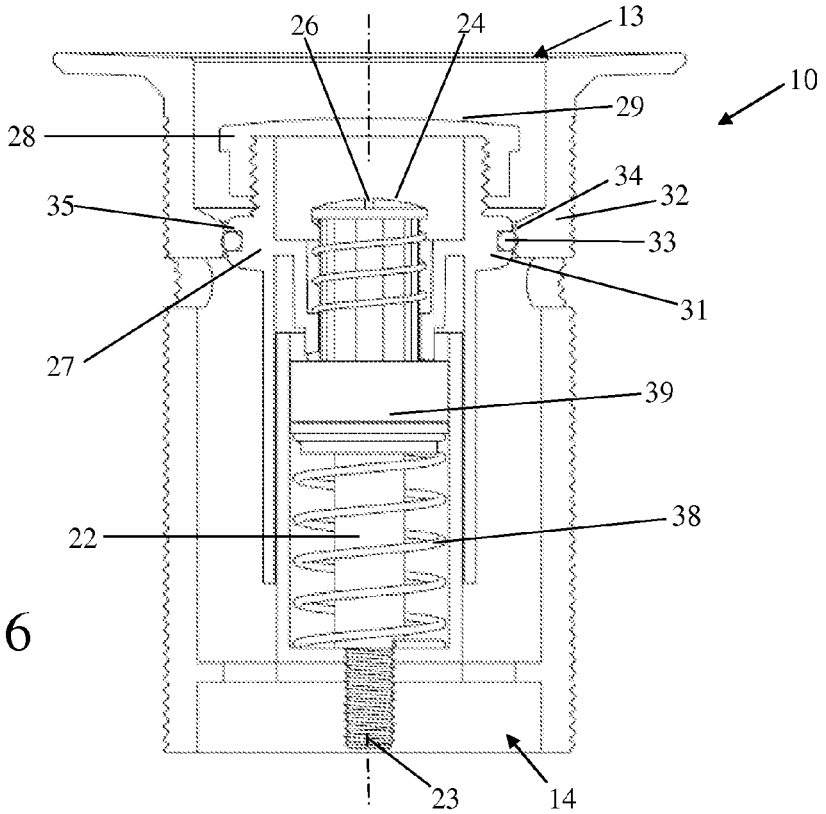
FIG. 6 is a sectional elevation of the plug of FIG. 1 along a diametral plane with the plug in the closed position.
Figure 7:
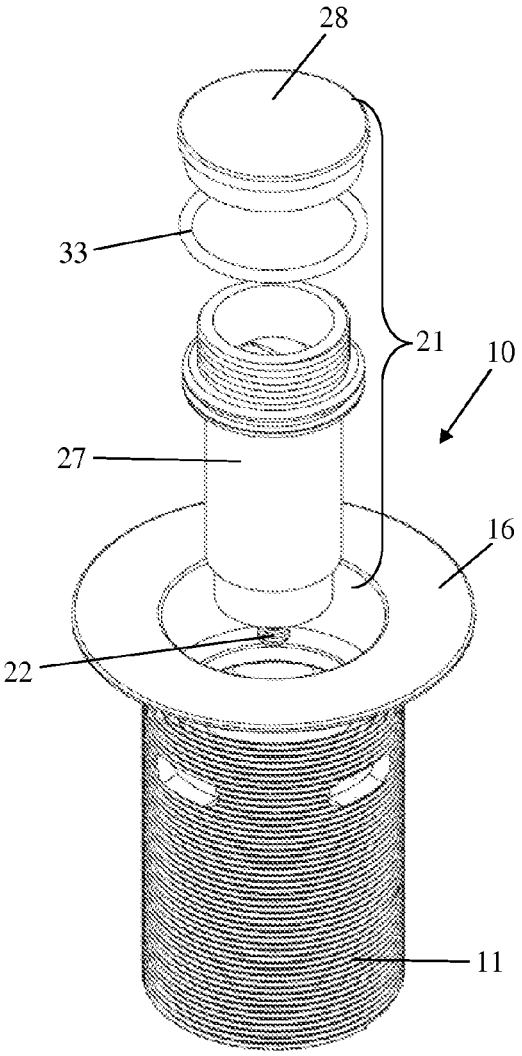
FIG. 7 is an isometric view of the basin waste of FIG. 1 with the plug in line for assembly with the actuation device and with the actuation device in line for assembly with the tube of the basin waste.
Figure 8:
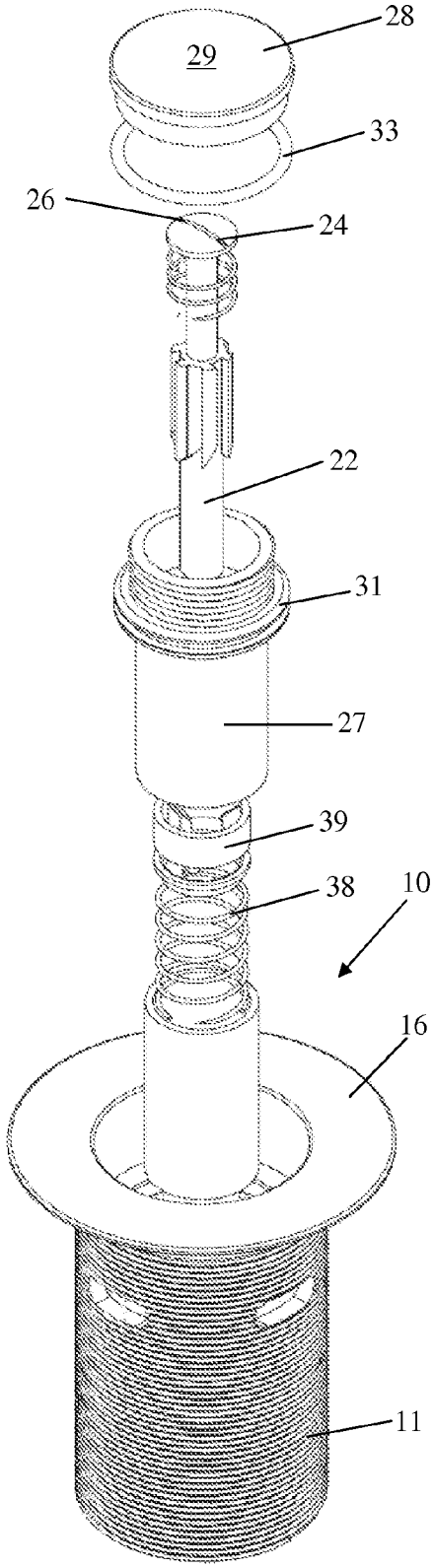
FIG. 8 is an isometric view of the basin waste of FIG. 1 with the plug and actuation device in line for assembly.

The plug assembly 21 includes a spindle 22 having a screw thread 23 at its lower end and a round head 24 with a screwdriver slot 26 therein at its upper end. A movable plug 27 is slideably mounted on the spindle for selective up and down movement relative thereto between an upper position as shown in FIGS. 1, 3 and 5 and a lower position as shown in FIGS. 2, 4 and 6. Suitably, a removable top cap 28 is screw threadedly mounted on the moveable plug at its upper end and as can be seen in the drawings, the top of the top cap is flush with the upper face of the flange 16 when in the up position and is below the level of the flange when in the down position. Suitably, the moveable plug 27 includes an outwardly extending flange 31 which sealingly engages the cylindrical face 34 of an inwardly extending flange 32 via O-ring 33 which is mounted in an O-ring groove 35 provided in the cylindrical outer face of the plug flange 31.

As can be seen in FIG. 5, when the moveable plug 27 is in the up position, the plug flange 31 is spaced from the tube flange 32 so as to form an angular flow passage 35 therebetween and when the moveable plug is in the down position, the plug flange engages with the tube flange via the O-ring 33 to close the angular passage.

The moveable plug is actuated by an "indexing" type actuator 37 of known type as used in the "pop-up" type basin outlets referred to earlier. The indexing actuator is arranged to allow the movable plug to be pushed down against the bias of spring 38 to catch in the closed position and to be released by again pushing the cap down so as to cause the collar 39 to index angularly about vertical axis 40 so as to release the plug and allow it to rise to the open position under the force of spring 38 in much the same manner as occurs in relation to the pop-up basin wastes previously referred.

Advantageously, it will be appreciated that the basin waste 10 is aesthetically pleasing from the top when in the open position with the upper face 29 of cap 28 being substantially flush with the upper face of flange 16 and showing an annular opening 45 between the top of the plug and the flange. The waste is also aesthetically pleasing when in the down (closed) position with the top of the plug forming an attractive "bottom" to the passage 12 in the tube 11.

It will be appreciated that access to the indexing mechanism can be gained by unscrewing the cap 28 whereupon the indexing mechanism can be unscrewed with a screwdriver if replacement of the indexing actuator is required.

In another embodiment, the plug is arranged to slide up and down on the spindle 22 but instead of being opened and closed by pushing in combination with the spring loaded indexing mechanism, it is raised and lowered by a push rod passing through the basin adjacent the faucet and connected to a lever which in turn extends through a slot in the tube and is pivotally connected to the plug. In such form, the lever rests on a fulcrum point inside the tube and is operative to force the plug up and down under the up and down action of the push rod. However, there are a number of variations which would work satisfactorily.

The foregoing description has been given by way of illustrative example of the invention and many modifications and variations which will be apparent to persons skilled in the art may be made without departing from the spirit and scope of the invention as hereinbefore described.

The claims defining the invention are as follows:

1. A bath or basin waste including a flange adapted to engage the upper face of the bottom of a bath or basin and a plug with an upper face wherein the upper face is substantially below the upper face of the flange when in the closed position and substantially flush with the upper face of the flange when in the open position, the waste being such that the only passage opening to the bath or basin to which the waste is fitted is an annular passage about the plug between the upper face of the plug and the upper face of the flange.

2. A bath or basin waste, including:

a tube defining a flow passage with an inlet at its upper end, an outlet at its lower end, and an outwardly extending flange at or adjacent its upper end;

a plug mounted in the flow passage for up and down movement between an open position in which the plug is up and a closed position when it is down, the plug having an upper face which is substantially flush with the upper face of the flange when in the open position and below the upper face of the flange when in the closed position; and actuation means for actuating movement of the plug relative to the tube between the closed position and the open position, wherein the actuation means is mounted in the flow passage and operatively connected to the plug; and wherein the upper face of the plug together with the tube defines a space therebetween through which water can flow.

3. A bath or basin waste, including:

a tube defining a flow passage with an inlet at its upper end, an outlet at its lower end, and an outwardly extending flange at or adjacent one end;

a plug mounted in the flow passage for up and down movement between an open position and a closed position in which flow between the plug and the tube is prevented, the plug having an upper face which is substantially flush with the upper face of the flange when in the open position but below the upper face of the flange when in the closed position and the upper face of the plug and the inner face of the tube defining a space between the upper face and the tube through which water flows in the open position; and actuation means for actuating movement of the plug relative to the tube between the closed position and the open position, wherein the actuation means is mounted in the flow passage and operatively connected to the plug.

4. A bath or basin waste according to claim 2 wherein the plug is adapted to sealably engage with the inner face of the tube to close the flow passage in the closed position and to disengage from the inner face in the open position so as to allow water to flow through the flow passage.

5. A bath or basin waste according to claim 3 wherein the plug includes an outwardly extending circumferential flange which engages with a circumferential flange extending inwardly from the inner face of the tube when in the closed position thereby closing the flow passage.

6. A bath or basin waste according to claim 1 wherein the plug includes a top cap and the upper face of the plug is the upper face of the top cap.

7. A bath or basin waste according to claim 6 wherein the space is an annular space which allows water to flow around the cap.

8. A bath or basin waste according to claim 5 wherein the plug includes a depending skirt and the plug is connected to the actuation means via the skirt.

9. A bath or basin waste according to claim 2 wherein the actuation means includes a spindle which is operatively mounted to the tube and the plug is slidably mounted on the spindle.

10. A bath or basin waste according to claim 2 wherein the actuation means includes a spring loaded angular indexing mechanism operable by pushing the plug downwards.

11. A bath or basin waste including a flange adapted to engage the upper face of the bottom of a bath or basin and a plug in which the upper face of the plug is substantially below the upper face of the flange when in the closed position and substantially flush with the upper face of the flange when in the open position, the waste being such that the only passage opening to the bath or basin to which the waste is to be fitted is an upwardly open annular passage about the plug.

12. A bath or basin waste, including:

a tube defining a flow passage with an inlet at its upper end, an outlet at its lower end, and an outwardly extending flange at or adjacent its upper end and adapted to engage with the upper face of the bath or basin to which it is to be fitted;

a plug mounted in the flow passage for up and down movement between an open position in which the plug is up and a closed position in which it is down, the plug having an upper face which is substantially flush with the upper face of the outwardly extending flange and which together with the tube defines an opening through which water can flow towards the outlet, the upper face of the plug being arranged to substantially cover or hide the outlet when the plug is in the open position; and actuation means for actuating movement of the plug relative to the tube between the closed position and the open position, wherein the actuation means is mounted in the flow passage and connected to the plug; and wherein the opening is an annular space between the upper face of the plug and the tube.

13. A bath or basin waste according to claim 12 wherein the tube includes an inwardly extending flange and a portion of the plug sealably engages with an inner face of the flange when in the closed position thereby closing the flow passage.

14. A bath or basin waste according to claim 12 wherein said opening is an annular space between the upper face of the plug and the tube.

15. A bath or basin waste according to claim 2 wherein the plug includes a top cap and the upper face of the top cap is the upper face of the plug.

* * * * *